US006691599B2

(12) United States Patent
Kao

(10) Patent No.: US 6,691,599 B2
(45) Date of Patent: Feb. 17, 2004

(54) CUTTER GUARD DEVICE FOR A BELT SAW MACHINE

(75) Inventor: Mei-Lan Kao, Taichung (TW)

(73) Assignee: P & F Brother Industrial Corporation, Taichung (TW)

( * ) Notice: Subject to any disclaimer, the term of this patent is extended or adjusted under 35 U.S.C. 154(b) by 85 days.

(21) Appl. No.: 10/042,133

(22) Filed: Jan. 11, 2002

(65) Prior Publication Data

US 2003/0131706 A1 Jul. 17, 2003

(51) Int. Cl.[7] ..... B26D 7/22

(52) U.S. Cl. ..... 83/814; 83/DIG. 1; 83/546; 83/544; 83/860; 74/616; 144/251.3

(58) Field of Search ..... 83/860, 814, 820, 83/829, 544, 545, 546, DIG. 1; 74/616; 144/251.1, 251.3

(56) References Cited

U.S. PATENT DOCUMENTS

| | | | | | |
|---|---|---|---|---|---|
| 418,422 | A | * | 12/1889 | Paul | 83/814 |
| 1,054,288 | A | * | 2/1913 | Fleming | 83/814 |
| 1,059,400 | A | * | 4/1913 | Seberg | 83/814 |
| 1,097,633 | A | * | 5/1914 | Hooper | 83/814 |
| 1,186,600 | A | * | 6/1916 | Neill | 83/814 |
| 1,841,939 | A | * | 1/1932 | Koning et al. | 83/814 |
| 2,193,946 | A | * | 3/1940 | Tautz | 83/820 |
| 2,371,731 | A | * | 3/1945 | Boice et al. | 83/814 |
| 2,538,456 | A | * | 1/1951 | Howe, Jr. | 83/814 |
| 3,104,688 | A | * | 9/1963 | Bretthauer | 83/814 |
| 3,888,148 | A | * | 6/1975 | Weissman | 83/100 |
| 3,974,724 | A | * | 8/1976 | Shadle | 83/68 |
| 4,204,444 | A | * | 5/1980 | Kohr | 83/56 |

* cited by examiner

*Primary Examiner*—Boyer Ashley
*Assistant Examiner*—Thomas J. Druan, Jr.
(74) *Attorney, Agent, or Firm*—Finnegan, Henderson, Farabow, Garrett & Dunner, L.L.P.

(57) ABSTRACT

A cutter guard device is adapted for use in a belt saw machine, and includes a stationary hinge leaf formed with a first knuckle unit, a movable hinge leaf formed with a second knuckle unit, and a hinge pin extending through the first and second knuckle units, thereby permitting rotation of the movable hinge leaf between cutter concealing and cutter exposing positions. The movable hinge leaf is further slidable along the hinge pin between retaining and pivoting positions. The movable hinge leaf is movable between the cutter concealing and cutter exposing positions when disposed in the pivoting position on the hinge pin. A retention unit retains releasably the movable hinge leaf in the cutter concealing position when the latter is further disposed in the retaining position on the hinge pin.

6 Claims, 8 Drawing Sheets

CUTTER GUARD DEVICE FOR A BELT SAW MACHINE

BACKGROUND OF THE INVENTION

1. Field of the Invention

The invention relates to a belt saw machine, more particularly to a cutter guard device for a belt saw machine.

2. Description of the Related Art

Referring to FIG. 1, a conventional belt saw machine is shown to comprise a C-shaped frame 1 and upper and lower drive rollers 2 mounted on the frame 1. An endless belt cutter 3 is trained on the drive rollers 2. A cutter replacement device 4 is mounted on the frame 1, and includes a push rod 401 coupled operably to the upper drive roller 2 for moving the same downwardly when replacement of the belt cutter 3 is intended.

The frame 1 is formed with a notch 101 through which a work piece (not shown) extends when cutting the latter. A portion of the belt cutter 3 is exposed from the frame 1 at the notch 101. The belt saw machine further includes a cutter guard device 6 for protecting the hands of the operator of the belt saw machine when cutting the work piece. The conventional cutter guard device 6 is formed as an angled plate, and includes amounting plate portion 601 and a blocking plate portion 602 transverse to the mounting plate portion 601. The mounting plate portion 601 is mounted adjustably on the frame 1 via a guard adjustment device 5. By operating an adjustment bolt 501 of the guard adjustment device 5, the cutter guard device 6 can be adjusted vertically relative to the frame 1 to correspond with the thickness of the work piece to be cut. As such, when cutting the work piece, the part of the belt cutter 3 that is exposed from the frame 1 at the notch 101 and that is above the work piece can be concealed by the cutter guard device 6 for enhancing safety during use.

A main drawback associated with the use of the conventional cutter guard device 6 resides in that the latter renders replacement of the belt cutter 3 inconvenient to conduct. In view of the integral construction of the cutter guard device 6, it has to be removed from the frame 1 before replacement of the belt cutter 3 can be conducted, and reassembled onto the frame 1 after completing replacement of the belt cutter 3.

SUMMARY OF THE INVENTION

Therefore, the object of the present invention is to provide a cutter guard device that does not require removal from a frame of a belt saw machine when replacing a belt cutter of the latter.

According to the present invention, a cutter guard device is adapted for use in a belt saw machine, and includes a stationary hinge leaf formed with a first knuckle unit, a movable hinge leaf formed with a second knuckle unit, and a hinge pin extending through the first and second knuckle units, thereby permitting rotation of the movable hinge leaf relative to the stationary hinge pin about the hinge pin for movement between a cutter concealing position and a cutter exposing position. The movable hinge leaf is further slidable relative to the stationary hinge leaf along the hinge pin between a retaining position and a pivoting position. The movable hinge leaf is movable between the cutter concealing and cutter exposing positions when the movable hinge leaf is disposed in the pivoting position on the hinge pin. A retention unit retains releasably the movable hinge leaf in the cutter concealing position when the movable hinge leaf is further disposed in the retaining position on the hinge pin.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
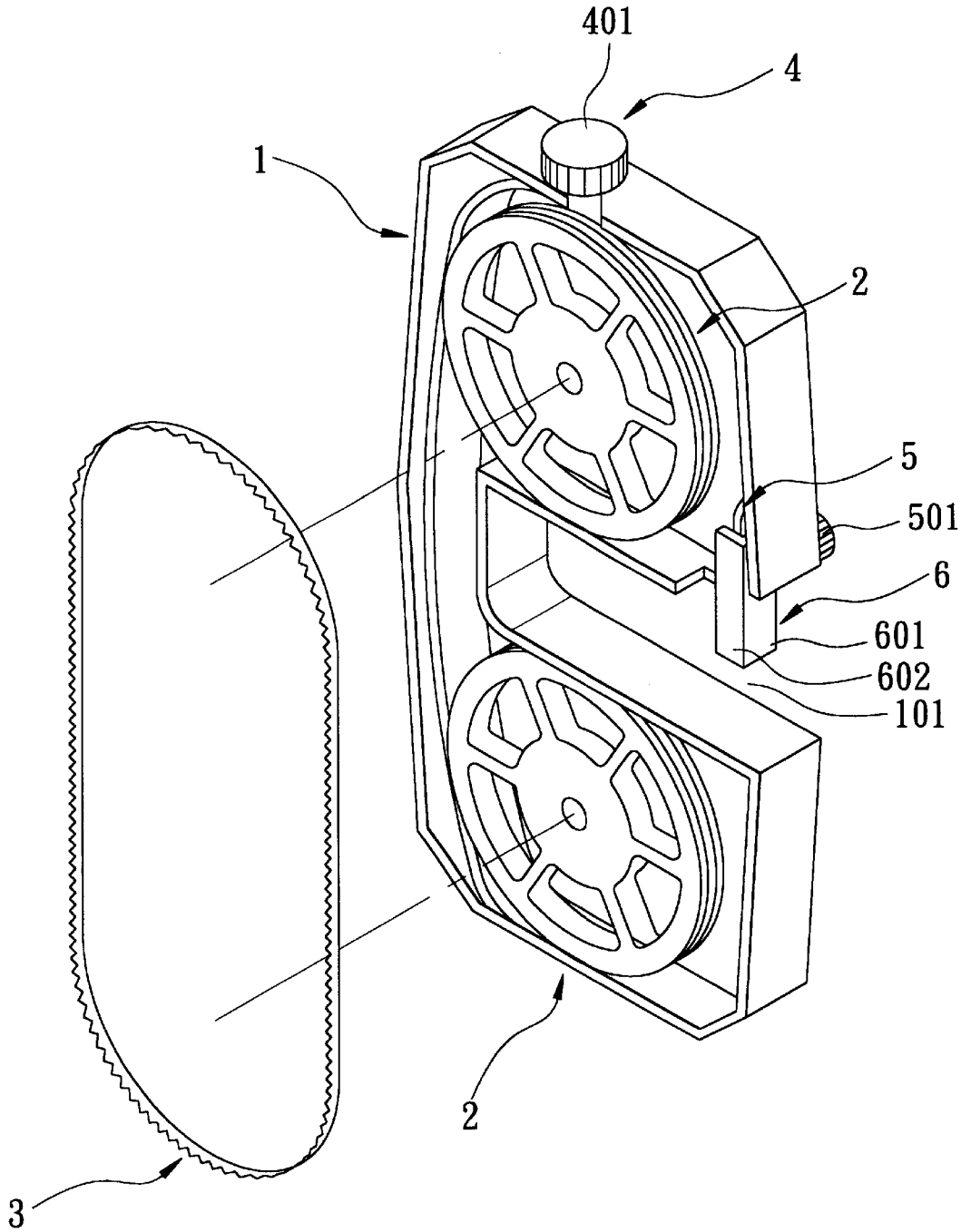
FIG. 1 PRIOR ART
FIG. 1 is a fragmentary partly exploded perspective view of a conventional belt saw machine.
Figure 2:
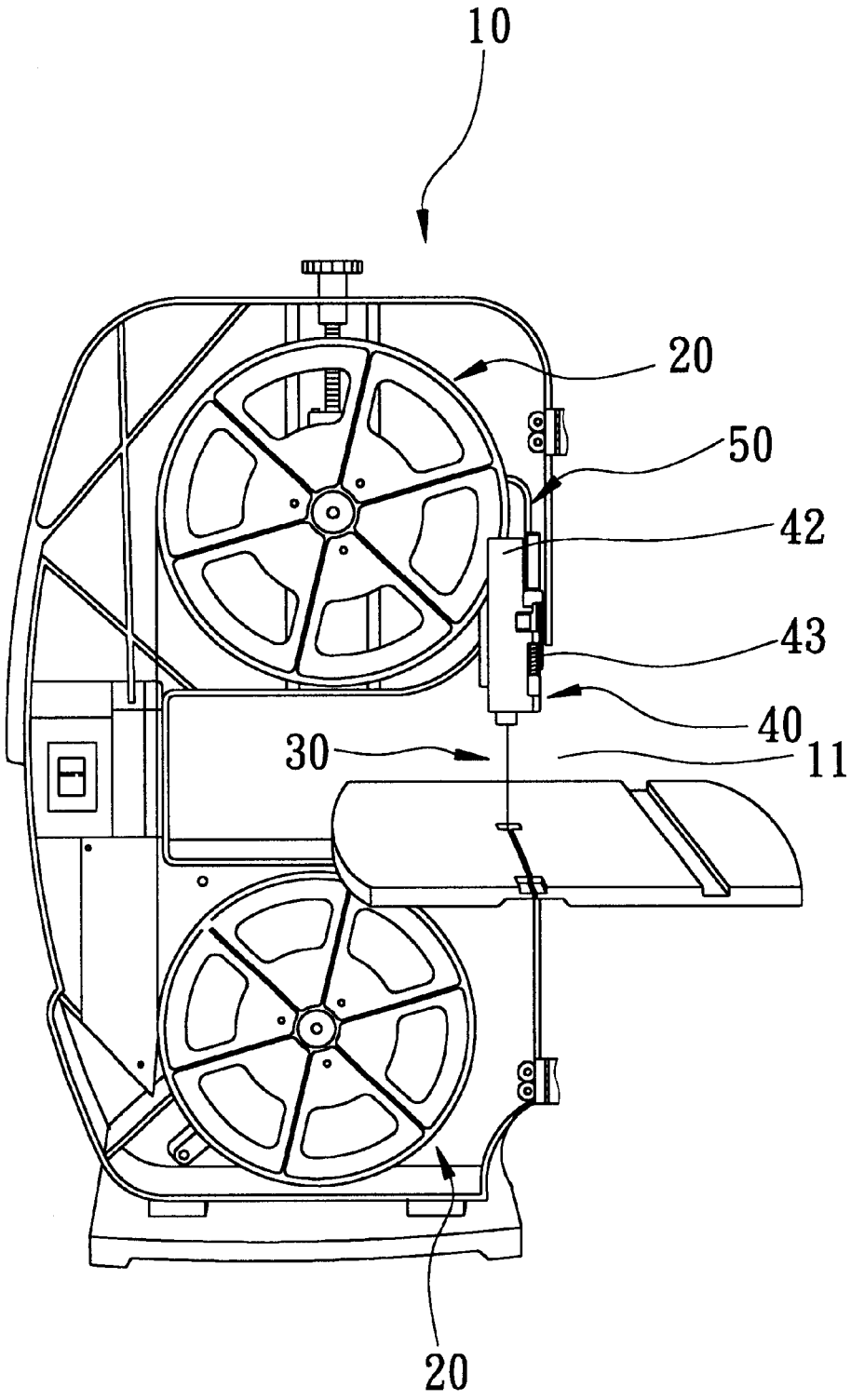
FIG. 2 is a fragmentary assembled perspective view of a belt saw machine that incorporates the preferred embodiment of a cutter guard device according to the present invention.

Referring to FIG. 2, the preferred embodiment of a cutter guard device 40 according to the present invention is shown to be adapted for use in a known belt saw machine that includes a C-shaped frame 10 and upper and lower drive rollers 20 mounted on the frame 10. An endless belt cutter 30 is trained on the drive rollers 20. The frame 10 is formed with a notch 11 through which a workpiece (not shown) extends when cutting the latter. A portion of the belt cutter 30 is exposed from the frame 10 at the notch 11. The cutter guard device 40 is mounted on the frame 10 adjacent to the portion of the belt cutter 30 that is exposed from the frame 10 so as to protect the hands of the operator of the belt saw machine when cutting the work piece.

Figure 3:
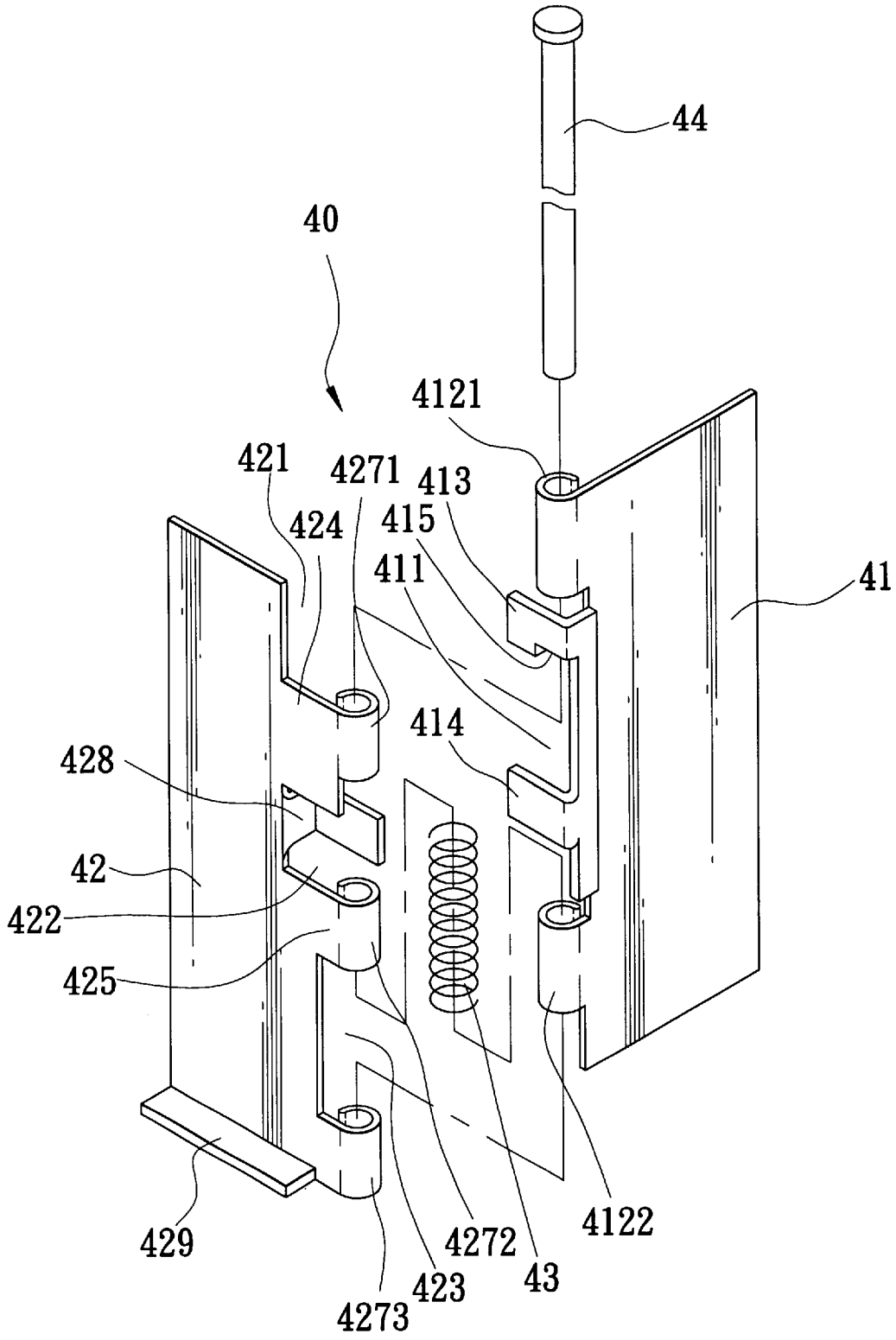
FIG. 3 is an exploded perspective view of the preferred embodiment.
Figure 4:
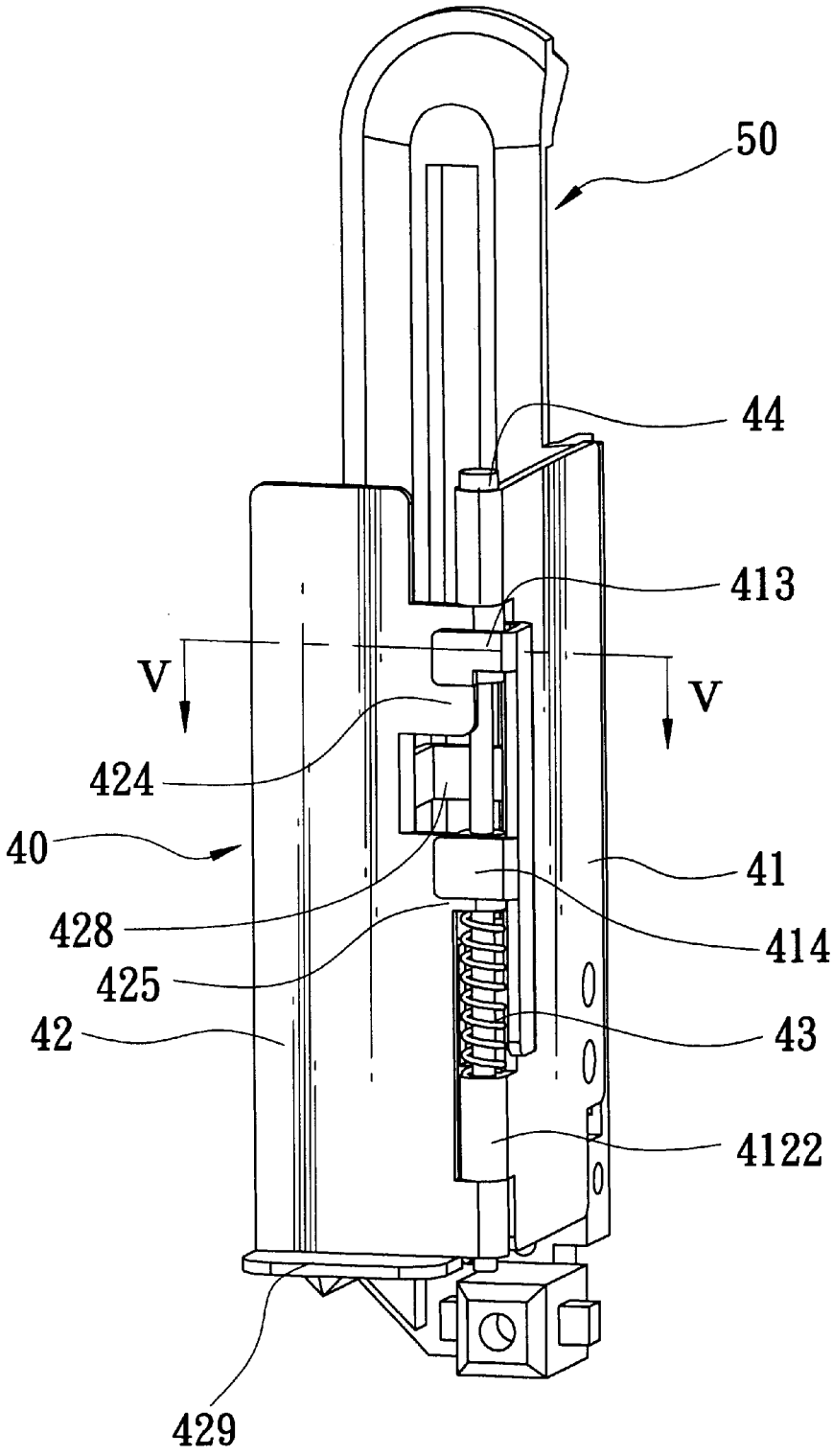
FIG. 4 is a perspective view illustrating the preferred embodiment when mounted on a guard adjustment device of the belt saw machine.

With further reference to FIGS. 3 and 4, the cutter guard device 40 includes a stationary hinge leaf 41, a movable hinge leaf 42, a biasing member 43, and a hinge pin 44.

The stationary hinge leaf 41 is adapted to be mounted adjustably on the frame 10 in a known manner via a guard adjustment device 50. The stationary hinge leaf 41 has a vertically extending coupling edge formed with a first knuckle unit that includes coaxial upper and lower knuckles 4121 and 4122. The knuckles 4121 and 4122 respectively have bottom and top ends that are vertically spaced apart from each other and that confine a knuckle recess 411 therebetween.

The movable hinge leaf 42 has a vertically extending coupling edge formed with a second knuckle unit that includes coaxial upper, middle and lower knuckles 4271, 4272, and 4273. The upper and middle knuckles 4271 and 4272 respectively have top and bottom ends that are vertically spaced apart by a distance shorter than the length of the knuckle recess 411, and are to be disposed in the knuckle recess 411. The middle and lower knuckles 4272 and 4273 respectively have bottom and top ends that are vertically spaced apart from each other and that cooperate to form a knuckle recess 423 having a vertical length longer than an axial length of the lower knuckle 4122 of the stationary hinge leaf 41. The lower knuckle 4122 of the stationary hinge leaf 41 is to be disposed in the knuckle recess 423. The coupling edge of the movable hinge leaf 42 is further formed with an upper notch 421 above the upper knuckle 4271, and a lower notch 422 between the upper and middle knuckles 4271 and 4272. The upper notch 421 extends to a top edge of the movable hinge leaf 42. Due to the presence of the upper and lower notches 421, 422, the coupling edge of the movable hinge leaf 42 is thus configured with an upper tab 424 connected to the upper knuckle 4271, and a lower tab 425 connected to the middle knuckle 4272. The movable hinge leaf 42 further has a bottom edge that is bent to form an operating part 429 that projects transversely from an outer side surface of the movable hinge leaf 42.

The biasing member 43, which is in the form of a compression spring coil, is disposed in the knuckle recess 423 between the middle knuckle 4272 of the movable hinge leaf 42 and the lower knuckle 4122 of the stationary hinge leaf 41. The biasing member 43 biases the middle knuckle 4272 of the movable hinge leaf 42 away from the lower knuckle 4122 of the stationary hinge leaf 41.

The hinge pin 44 extends in sequence through the upper knuckle 4121 of the stationary hinge leaf 41, the upper and middle knuckles 4271 and 4272 of the movable hinge leaf 42, the biasing member 43, the lower knuckle 4122 of the stationary hinge leaf 41, and the lower knuckle 4273 of the movable hinge leaf 42. The movable hinge leaf 42 is thus rotatable relative to the stationary hinge leaf 41 about the axis of the hinge pin 44 for movement between a cutter concealing position (see FIG. 4) and a cutter exposing position (see FIG. 8).

Figure 6:
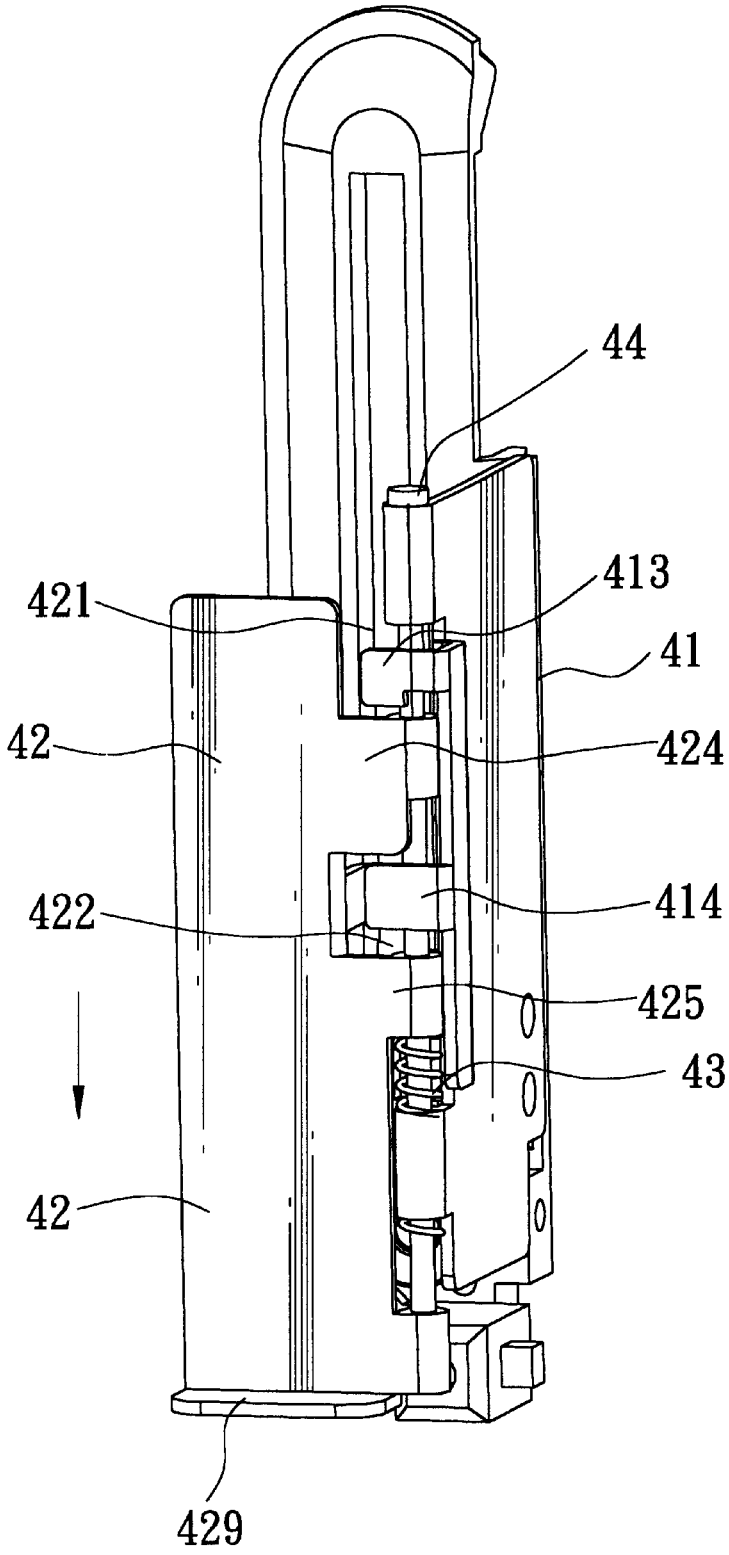
FIGS. 6 to 8 are views similar to FIG. 4, illustrating how the preferred embodiment is operated when it is desired to replace a belt cutter of the belt saw machine.

The movable hinge leaf 42 is further slidable relative to the stationary hinge leaf 41 along the hinge pin 44 between a retaining position (see FIG. 4) and a pivoting position (see FIG. 6). The biasing member 43 biases the movable hinge leaf 42 to the retaining position on the hinge pin 44. The movable hinge leaf 42 is movable between the cutter concealing and exposing positions when the movable hinge leaf 42 is moved to the pivoting position on the hinge pin 44 against the action of the biasing member 43.

The stationary hinge leaf 41 is provided with a retention unit that includes a pair of vertically spaced apart first and second limit plates 413,414. Each of the first and second limit plates 413, 414 has a mounting end part fixed to the coupling edge of the stationary hinge leaf 41, such as by welding. The first and second limit plates 413, 414 are disposed between the knuckles 4121 and 4122 of the stationary hinge leaf 41. Each of the first and second limit plates 413, 414 further has a distal end part that extends from the mounting end part, that is transverse to the stationary hinge leaf 41, and that is adjacent to the knuckle recess 411. The first and second limit plates 413, 414 are capable of retaining releasably the movable hinge leaf 42 in the cutter concealing position when the movable hinge leaf 42 is further disposed in the retaining position on the hinge pin 44. As shown in FIG. 4, the distal end parts of the first and second limit plates 413, 414 are disposed to abut respectively against the upper and lower tabs 424, 425 at the outer side surface of the movable hinge leaf 42, thereby arresting counterclockwise rotation of the movable hinge leaf 42 relative to the stationary hinge leaf 41 from the cutter concealing position to the cutter exposing position.

In use, when it is desired to replace the belt cutter 30 (see FIG. 2), a downward pressing force is applied on the operating part 429 of the movable hinge leaf 42, as shown in FIG. 6. At this time, the movable hinge leaf 42 moves downwardly along the hinge pin 44 from the retaining position to the pivoting position, and compresses the biasing member 43. The distal end parts of the first and second limit plates 413, 414 cease to be aligned with the upper and lower tabs 424, 425 and are aligned instead with the upper and lower notches 421, 422, respectively. Because the first and second limit plates 413, 414 no longer engage the upper and lower tabs 424, 425, the movable hinge leaf 42 can be rotated in the counterclockwise direction about the axis of the hinge pin 44 from the cutter concealing position of FIGS. 4 and 6 to the cutter exposing position shown in FIG. 7.

Figure 5:
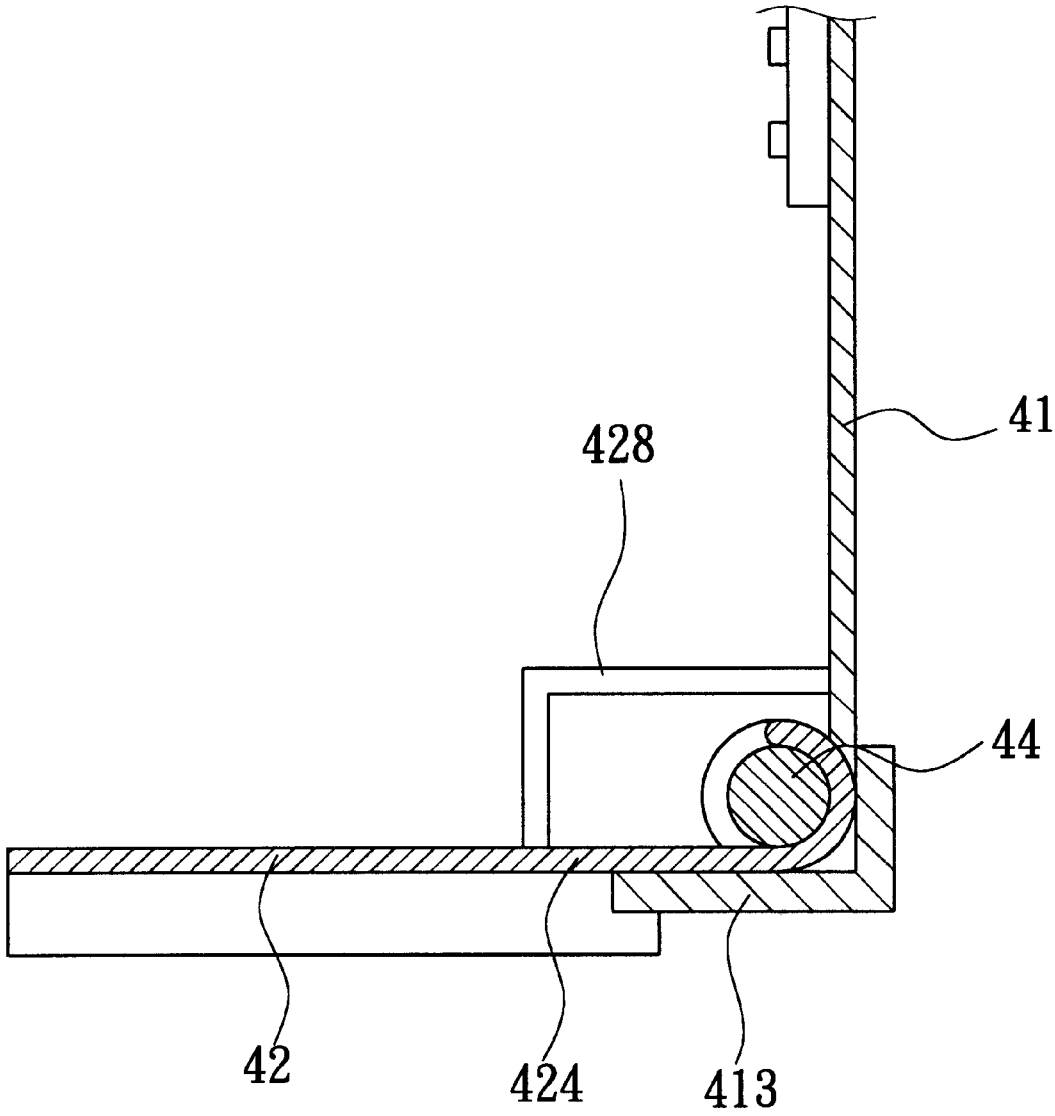
FIG. 5 is a sectional view of the preferred embodiment, taken along lines V—V in FIG. 4.
Figure 7:
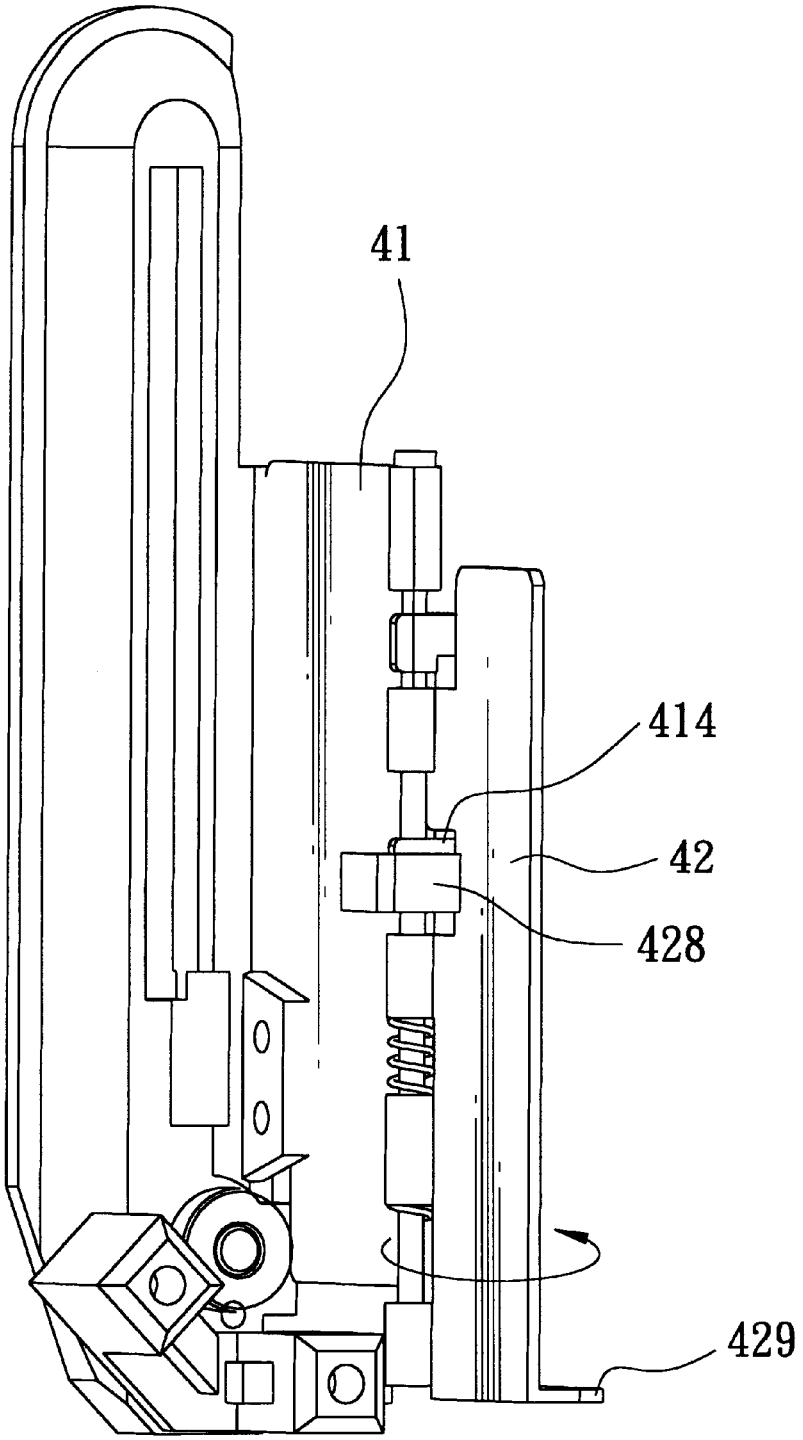

With further reference to FIG. 5, the movable hinge leaf 42 is formed with an L-shaped stop member 428 having a connecting end part that is connected to the movable hinge leaf 42 between the upper and lower tabs 424, 425 and that projects transversely from an inner side surface of the movable hinge leaf 42, and a stopping end part that extends transverse to the connecting end part in a direction toward the coupling edge of the movable hinge leaf 42. As shown in FIG. 7, when the movable hinge leaf 42 reaches the cutter exposing position, the stop member 428 initially engages the second limit plate 414 to limit further counterclockwise rotation of the movable hinge leaf 42.

Subsequently, with reference to FIG. 8, when the operating part 429 of the movable hinge leaf 42 is relieved from the downward pressing force, the biasing member 43 expands to move the movable hinge leaf 42 upwardly along the axis of the hinge pin 44 from the pivoting position back to the retaining position. At this time, because the distal end part of the first limit plate 413, which is disposed above the second limit plate 414, has a bottom edge formed with an engaging groove 415, the top edge of the upper tab 424 can extend into the engaging groove 415 to retain releasably the movable hinge leaf 42 in the cutter exposing position. Replacement of the belt cutter 30 can be conducted at this time.

Figure 8:
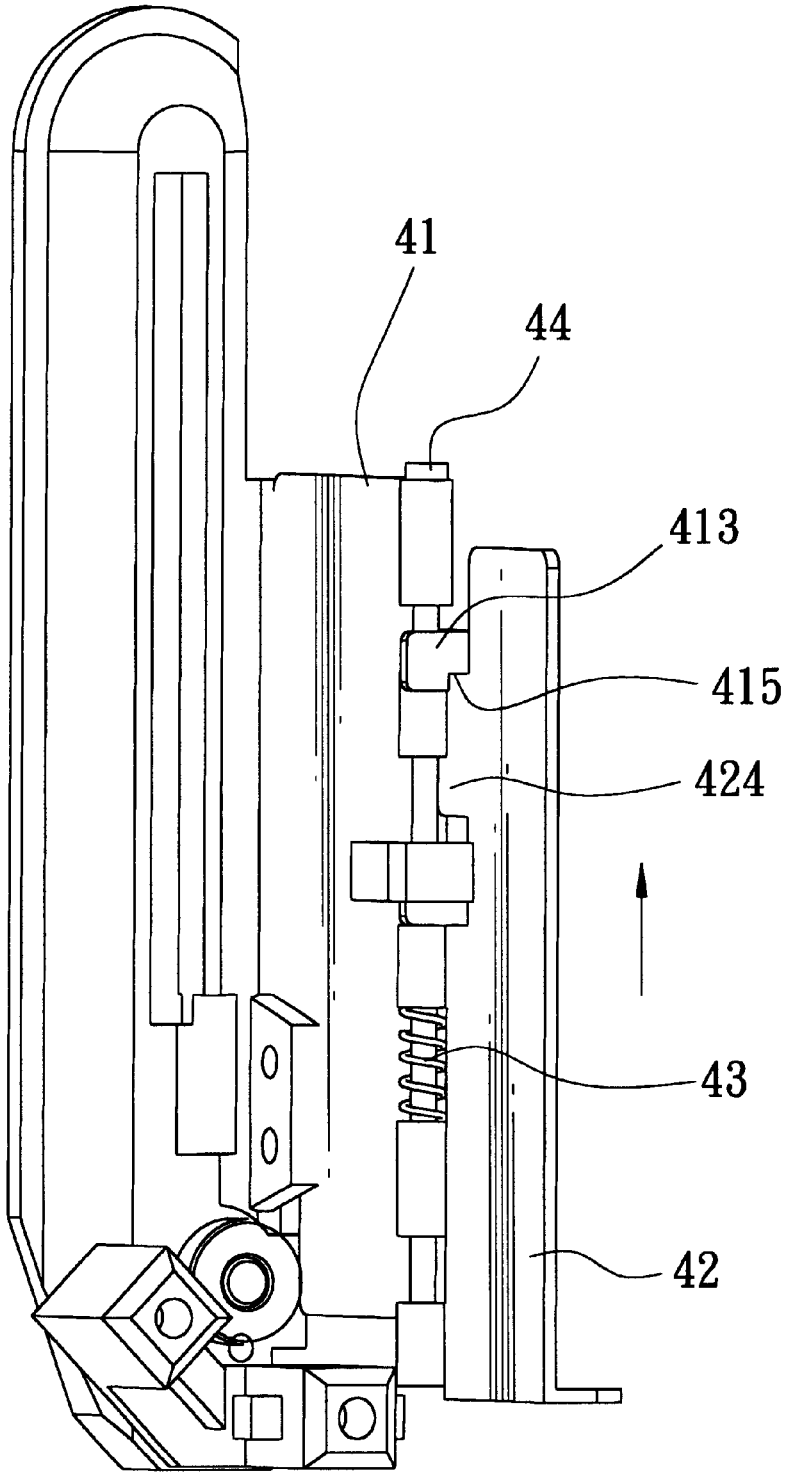

Accordingly, to restore the movable hinge leaf 42 from the cutter exposing position of FIG. 8 to the cutter concealing position of FIG. 4, a downward pressing force is once again applied on the movable hinge leaf 42 to move the latter from the retaining position to the pivoting position on the hinge pin 44. Thereafter, the movable hinge leaf 42 is rotated in the clockwise direction about the axis of the hinge pin 44 until the stopping end part of the stop member 428 abuts against an inner side surface of the stationary hinge leaf 41, thereby limiting movement of the movable hinge leaf 42 from the cutter exposing position to the cutter concealing position, as best shown in FIG. 5. Then, when the movable hinge leaf 42 is relieved from the downward pressing force, the biasing member 43 expands to restore the movable hinge leaf 42 to the state shown in FIG. 4.

It has thus been shown that the cutter guard device 40 of this invention permits replacement of the belt cutter 30 without the need for removing the former from the frame 10. The object of the present invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A cutter guard device for a belt saw machine, said cutter guard device comprising:

a stationary hinge leaf having a coupling edge formed with a first knuckle unit;

a movable hinge leaf having a coupling edge formed with a second knuckle unit;

a hinge pin extending through said first and second knuckle units, thereby permitting rotation of said movable hinge leaf relative to said stationary hinge pin about said hinge pin for movement between a cutter concealing position and a cutter exposing position;

said movable hinge leaf being further slidable relative to said stationary hinge leaf along said hinge pin between a retaining position and a pivoting position;

said movable hinge leaf being movable between the cutter concealing and cuter exposing positions when said movable hinge leaf is disposed in the pivoting position on said hinge pin; and a retention unit capable of retaining releasably said movable hinge leaf in the cutter concealing position when said movable hinge leaf is further disposed in the retaining position on said hinge pin;

wherein said coupling edge of said movable hinge leaf is formed with a notch, thereby configuring said coupling edge of said movable hinge leaf with a tab that is adjacent to said notch, said retention unit including a limit plate having a mounting end part mounted to said coupling edge of said stationary hinge leaf, and a distal end part that extends from said mounting end part and that is transverse to said stationary hinge leaf, said distal end part of said limit plate abutting against said tab at an outer side surface of said movable hinge leaf to arrest rotation of said movable hinge leaf from the cutter concealing position to the cutter exposing position when said movable hinge leaf is disposed in the retaining position on said hinge pin, and said distal end part of said limit plate being aligned with said notch in said coupling edge of said movable hinge leaf to permit rotation of said movable hinge leaf from the cutter concealing position to the cutter exposing position when said movable hinge leaf is disposed in the pivoting position on said hinge pin.

2. The cutter guard device of claim 1, wherein said limit plate has a bottom edge formed with an engaging groove for engaging releasably said movable hinge leaf in the cutter exposing position when said movable hinge leaf is further disposed in the retaining position on said hinge pin.

3. The cutter guard of claim 1, further comprising a biasing member for biasing said movable hinge leaf to the retaining position on said hinge pin.

4. The cutter guard device of claim 3, wherein said biasing member includes a compression spring coil sleeved on said hinge pin and disposed between said first and second knuckle units.

5. The cutter device of claim 1, wherein said movable hinge leaf is formed with an operating part to facilitate movement of said movable hinge leaf between the retaining and pivoting positions on said hinge pin.

6. The cutter guard device of claim 1, wherein said movable hinge leaf is formed with a stop member that abuts against an inner side surface of said stationary hinge leaf to limit movement of said movable hinge leaf from the cutter exposing position to the cutter concealing position.

* * * * *